US009804511B2

(12) United States Patent
Takeuchi et al.

(10) Patent No.: US 9,804,511 B2
(45) Date of Patent: Oct. 31, 2017

(54) ELECTROPHOTOGRAPHIC PHOTORECEPTOR, ELECTROPHOTOGRAPHIC APPARATUS COMPRISING THE SAME, AND PACKAGE OF ELECTROPHOTOGRAPHIC PHOTORECEPTOR

(71) Applicant: FUJI ELECTRIC CO., LTD., Kawasaki-shi, Kanagawa (JP)

(72) Inventors: Masaru Takeuchi, Matsumoto (JP); Hirotaka Kobayashi, Matsumoto (JP); Toshiki Obinata, Azumino (JP); Toshiki Takeuchi, Matsumoto (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 15/279,874

(22) Filed: Sep. 29, 2016

(65) Prior Publication Data

US 2017/0146916 A1 May 25, 2017

(30) Foreign Application Priority Data

Nov. 19, 2015 (JP) ..... 2015-226828

(51) Int. Cl.

| | |
|---|---|
| ***G03G 5/00*** | (2006.01) |
| ***G03G 5/06*** | (2006.01) |
| ***G03G 5/047*** | (2006.01) |

(52) U.S. Cl.

CPC ..... *G03G 5/0631* (2013.01); *G03G 5/047* (2013.01); *G03G 5/0609* (2013.01);

(Continued)

(58) Field of Classification Search

CPC .. G03G 5/0631; G03G 5/0614; G03G 5/0618; G03G 5/0635

(Continued)

(56) References Cited

U.S. PATENT DOCUMENTS

| | | | |
|---|---|---|---|
| 4,860,898 | A | 8/1989 | Hiro et al. |
| 6,287,736 | B1 | 9/2001 | Takaki et al. |

FOREIGN PATENT DOCUMENTS

| | | | |
|---|---|---|---|
| JP | S64-70785 | A | 3/1989 |
| JP | 2001-066805 | A | 3/2001 |

(Continued)

*Primary Examiner* — Mark A Chapman

(74) *Attorney, Agent, or Firm* — Manabu Kanesaka

(57) ABSTRACT

In a negatively-chargeable laminate-type electrophotographic photoreceptor, a charge generation layer and another charge transport layer are arranged on a conductive substrate directly or via an intermediate layer. The charge transport layer contains at least a hole-transporting substance, an electron-transporting substance and a binder resin; the mass ratio ($R_{PN}$) [% by mass] between mass (P) of the hole-transporting substance and mass (N) of the electron-transporting substance is represented by the following equation (1), and satisfies the following equation (2):

$$R_{PN}=(N/(P+N))\times 100 \quad (1)$$

$$1\leq R_{PN}\leq 40 \quad (2); \text{ and}$$

when a voltage of +6 kV is applied to the photoreceptor for 5 seconds via a resin sheet having a thickness of 50 μm and a surface resistivity of $2\times10^7$ Ω/cm$^2$, the surface potential difference (ΔVo) and half-tone potential difference (ΔVh) between before and after the voltage application are both 15 V or less.

6 Claims, 1 Drawing Sheet

(52) U.S. Cl.
CPC ..... *G03G 5/0614* (2013.01); *G03G 5/0618* (2013.01); *G03G 5/0635* (2013.01)

(58) Field of Classification Search
USPC ..... 430/58.35
See application file for complete search history.

(56) References Cited

FOREIGN PATENT DOCUMENTS

| | | | |
|---|---|---|---|
| JP | 2003-140368 | A | 5/2003 |
| JP | 2005-234488 | A | 9/2005 |
| JP | 2013-029789 | A | 2/2013 |
| JP | 2013-246364 | A | 12/2013 |
| JP | 2015-094839 | A | 5/2015 |

ELECTROPHOTOGRAPHIC PHOTORECEPTOR, ELECTROPHOTOGRAPHIC APPARATUS COMPRISING THE SAME, AND PACKAGE OF ELECTROPHOTOGRAPHIC PHOTORECEPTOR

RELATED APPLICATIONS

The present application is based on, and claims priority from, Japanese Application No. JP2015-226828 filed Nov. 19, 2015, the disclosure of which is hereby incorporated by reference herein in its entirety.

TECHNICAL FIELD

The present invention relates to an electrophotographic photoreceptor (hereinafter, also referred to as "photoreceptor") and an electrophotographic apparatus using the same, as well as an improvement in a package of an electrophotographic photoreceptor.

BACKGROUND ART

Conventionally, as electrophotographic photoreceptors used in electrophotographic application devices employing the Carlson method such as copying machines, printers and facsimile machines, inorganic photoreceptors utilizing an inorganic photoconductive material such as selenium, selenium alloy, zinc oxide or cadmium sulfide have been often used. However, recently, organic photoreceptors that utilize an organic photoconductive material have been actively developed taking advantage of the pollution-free properties, film-forming properties and lightweightness of such material.

Particularly, so-called function-separated laminate-type organic photoreceptors, in which a photosensitive layer is functionally separated into a charge generation layer primarily having a charge carrier-generating function upon reception of light and a charge transport layer primarily having a charge potential-maintaining function in the dark and a charge carrier-transporting function upon reception of light and these layers are laminated, have been the mainstream in organic photoreceptors since such photoreceptors have many advantages in that, for example, the properties can be easily controlled by forming each layer using a material suitable for the function of the layer.

However, these organic photoreceptors have a problem in that, due to their relatively soft surfaces, they are easily damaged by external factors. In addition, these photoreceptors also have a problem in that a fatigue phenomenon is likely to occur in their electrophotographic properties when exposed to ambient light. In this respect, as a solution to these problems, there has been proposed a packaging method in which a light-shielding protective member is wrapped around a photoreceptor and the thus wrapped photoreceptor is fixed with an adhesive tape.

Nevertheless, in such a packaging method, there is a case where removal of the wrapping light-shielding protective member from the photoreceptor generates a triboelectric charge between the light-shielding protective member and the photoreceptor and a static charge is thereby accumulated on the photoreceptor surface, causing appearance of image unevenness, which is so-called charge memory, when the photoreceptor is subjected to printing in an electrophotographic apparatus. In order to inhibit the generation of image unevenness caused by such charge memory, for example, in Japanese Unexamined Patent Application Publication No. S64-70785, it is proposed to use, as a packaging material of a photoreceptor, a material that generates a frictional electrostatic charge on the photoreceptor surface in the same polarity as the charge of the photoreceptor. In Japanese Unexamined Patent Application Publication No. S64-70785, for example, with regard to a negatively chargeable photoreceptor whose surface layer comprises a polycarbonate resin as a binder resin, it is disclosed to use, as a protective member, a resin film mainly composed of strongly electron-donating nylon or the like.

Further, as prior arts relating to an improvement of a photoreceptor, for example, in Japanese Unexamined Patent Application Publication No. 2001-66805, for the purpose of providing a favorable electrophotographic photoreceptor which has an improved stability of electrical properties during repeated use, changes in the conditions of use environment and the like with no generation of image defect such as memory, it is proposed to incorporate a specific electron-transporting compound into a charge transport layer in a laminate-type electrophotographic photoreceptor that comprises a photosensitive layer in which a charge generation layer and the charge transport layer are sequentially laminated. In addition, in Japanese Unexamined Patent Application Publication No. 2003-140368, for the purpose of suppressing adhesion of hydrophobic silica to the photoreceptor surface and thereby inhibiting toner filming caused by this adhesion, it is proposed to incorporate an electron-accepting substance into a charge transport layer of a laminate-type organic photoreceptor so as to control the amount of triboelectric charge generated between the photoreceptor and a cleaning blade in a prescribed range.

Moreover, in Japanese Unexamined Patent Application Publication No. 2005-234488, for the purpose of providing a laminate-type electrophotographic photoreceptor that has high sensitivity and causes neither image fogging nor exposure memory, it is proposed to incorporate a specific stilbene derivative as a positive hole-transporting agent and a specific dinaphthoquinone derivative as an electron-transporting agent into a charge transport layer. Furthermore, in Japanese Unexamined Patent Application Publication No. 2013-29789, for the purpose of providing a laminate-type electrophotographic photoreceptor having excellent light resistance, it is proposed to, in a photoreceptor in which a charge generation layer and a charge transport layer are sequentially laminated with the charge transport layer being formed on the surface, incorporate a specific tetraphenylbenzidine compound or a specific triphenylamino group-containing styryl compound along with a specific pyrazolonylidene-2,6-di-t-butyl-benzoquinone compound into the charge transport layer.

SUMMARY OF THE INVENTION

Problems to be Solved by the Invention

However, such a resin film as described in Japanese Unexamined Patent Application Publication No. S64-70785 is more expensive than those papers that are commonly and widely used as protective members and the application thereof, therefore, remains limited to those photoreceptors for some of high-grade electrophotographic apparatuses. Furthermore, none of those technologies disclosed in Japanese Unexamined Patent Application Publication Nos. 2001-66805, 2003-140368, 2005-234488 and 2013-29789 aim at suppression of charge memory, and these Patent Documents do not mention the changes in surface potential and half-tone potential at the time of applying a positive voltage to the photoreceptor surface.

In view of the above, an object of the present invention is to provide, in an inexpensive manner: an electrophotographic photoreceptor in which, even without the use of an expensive resin film as a protective member, the generation of charge memory can be inhibited regardless of the material of the protective member of the photoreceptor; an electrophotographic apparatus comprising the electrophotographic photoreceptor; and a package of an electrophotographic photoreceptor.

Means for Solving the Problems

The present inventors intensively studied to solve the above-described problems and discovered that, in a negatively-chargeable laminate-type electrophotographic photoreceptor, the generation of charge memory is inhibited by incorporating a hole-transporting substance and an electron-transporting substance at a specific ratio into a charge transport layer, thereby completing the present invention.

That is, the electrophotographic photoreceptor according to the present invention is a negatively-chargeable laminate-type electrophotographic photoreceptor in which a charge generation layer and a charge transport layer are arranged in the order mentioned on a conductive substrate directly or via an intermediate layer, wherein: the charge transport layer comprises at least a hole-transporting substance, an electron-transporting substance and a binder resin; the mass ratio ($R_{PN}$) [% by mass] between the mass (P) of the hole-transporting substance and the mass (N) of the electron-transporting substance, which mass ratio is represented by the following equation (1), satisfies the following equation (2):

$$R_{PN}=(N/(P+N))\times 100 \quad (1)$$

$$1\leq R_{PN}\leq 40 \quad (2); \text{ and}$$

when a voltage of +6 kV is applied to the electrophotographic photoreceptor for 5 seconds via a resin sheet having a thickness of 50 μm and a surface resistivity of $2\times10^7$ $\Omega cm^2$, the surface potential difference (ΔVo) and half-tone potential difference (ΔVh) between before and after application of the voltage are both 15 V or less.

In the photoreceptor of the present invention, it is preferred that at least one of the electron-transporting substance be any one of compounds having a structure represented by one of the following Formulae (ET1) to (ET3):

(ET1)

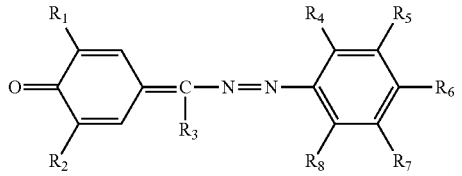

(wherein, $R_1$ and $R_2$, the same or different, represent a hydrogen atom, an alkyl group having 1 to 12 carbon atoms, an alkoxy group having 1 to 12 carbon atoms, an aryl group optionally having a substituent, a cycloalkyl group, an aralkyl group optionally having a substituent or a halogenated alkyl group;

$R_3$ represents a hydrogen atom, an alkyl group having 1 to 6 carbon atoms, an alkoxy group having 1 to 6 carbon atoms, an aryl group optionally having a substituent, a cycloalkyl group, an aralkyl group optionally having a substituent or a halogenated alkyl group;

$R_4$ to $R_8$, the same or different, represent a hydrogen atom, a halogen atom, an alkyl group having 1 to 12 carbon atoms, an alkoxy group having 1 to 12 carbon atoms, an aryl group optionally having a substituent, an aralkyl group optionally having a substituent, a phenoxy group optionally having a substituent, a halogenated alkyl group, a cyano group or a nitro group, or two or more of these groups optionally bind with each other to form a ring; and the substituents represent a halogen atom, an alkyl group having 1 to 6 carbon atoms, an alkoxy group having 1 to 6 carbon atoms, a hydroxyl group, a cyano group, an amino group, a nitro group or a halogenated alkyl group);

(ET2)

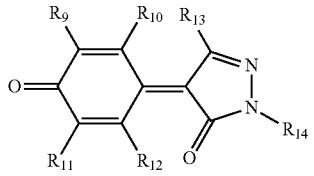

(wherein, $R_9$ to $R_{14}$, the same or different, represent a hydrogen atom, a halogen atom, a cyano group, a nitro group, a hydroxyl group, an alkyl group having 1 to 12 carbon atoms, an alkoxy group having 1 to 12 carbon atoms, an aryl group optionally having a substituent, a heterocyclic group optionally having a substituent, an ester group, a cycloalkyl group, an aralkyl group optionally having a substituent, an allyl group, an amide group, an amino group, an acyl group, an alkenyl group, an alkynyl group, a carboxyl group, a carbonyl group, a carboxylate group or a halogenated alkyl group; and the substituents represent a halogen atom, an alkyl group having 1 to 6 carbon atoms, an alkoxy group having 1 to 6 carbon atoms, a hydroxyl group, a cyano group, an amino group, a nitro group or a halogenated alkyl group); and (ET3)

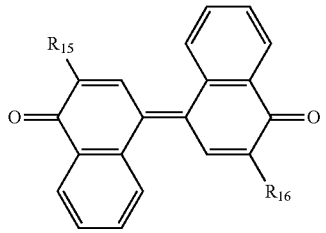

(wherein, $R_{15}$ and $R_{16}$, the same or different, represent a hydrogen atom, a halogen atom, a cyano group, a nitro group, a hydroxyl group, an alkyl group having 1 to 12 carbon atoms, an alkoxy group having 1 to 12 carbon atoms, an aryl group optionally having a substituent, a heterocyclic group optionally having a substituent, an ester group, a cycloalkyl group, an aralkyl group optionally having a substituent, an allyl group, an amide group, an amino group, an acyl group, an alkenyl group, an alkynyl group, a carboxyl group, a carbonyl group, a carboxylate group or a halogenated alkyl group; and the substituents represent a halogen atom, an alkyl group having 1 to 6 carbon atoms, an alkoxy group having 1 to 6 carbon atoms, a hydroxyl group, a cyano group, an amino group, a nitro group or a halogenated alkyl group).

Further, the electrophotographic apparatus according to the present invention comprises: the above-described electrophotographic photoreceptor of the present invention; a charging means which charges the electrophotographic photoreceptor; an exposure means which exposes the thus charged electrophotographic photoreceptor to form an electrostatic latent image; a developing means which develops the electrostatic latent image formed on the electrophotographic photoreceptor with a toner to form a toner image; a transfer means which transfers the toner image formed on the electrophotographic photoreceptor to a recording medium; and a fixation means which fixes the toner image transferred to the recording medium.

Still further, the package of an electrophotographic photoreceptor according to the present invention is a package of an electrophotographic photoreceptor in which the above-described electrophotographic photoreceptor of the present invention is covered with a black sheet article, wherein the black sheet article has a thickness of 30 to 80 μm and a surface resistivity of $10^2$ to $10^{11}$ Ω/cm$^2$.

Effects of the Invention

According to the present invention, an electrophotographic photoreceptor in which the generation of charge memory can be inhibited regardless of the material of a protective member of the photoreceptor; an electrophotographic apparatus comprising the electrophotographic photoreceptor; and a package of an electrophotographic photoreceptor can be realized inexpensively. Therefore, according to the present invention, an electrophotographic photoreceptor and an electrophotographic apparatus, which do not adversely affect the electrophotographic properties or generate charge memory even with the use of an inexpensive paper or the like as a protective member and which have excellent mass productivity, can be provided inexpensively.

MODE FOR CARRYING OUT THE INVENTION

Figure 1:
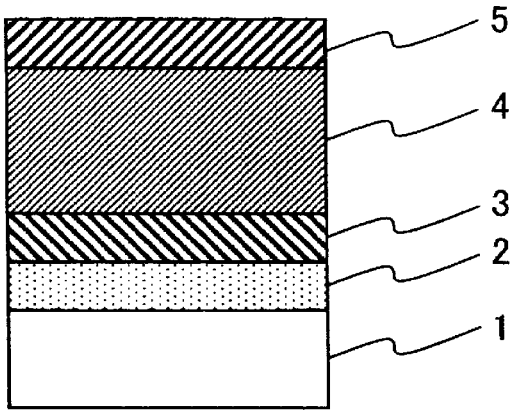
FIG. 1 is a schematic cross-sectional view showing one example of the electrophotographic photoreceptor of the present invention.

Embodiments of the present invention will now be described in detail referring to the drawings.

FIG. 1 is a schematic cross-sectional view of a negatively-chargeable laminate-type electrophotographic photoreceptor that shows one embodiment of the electrophotographic photoreceptor of the present invention, and the symbols 1, 2, 3, 4 and 5 represent a conductive substrate, an intermediate layer, a charge generation layer, a charge transport layer and a protective layer, respectively. It is noted here that the photoreceptor of the present invention may be a photoreceptor comprising the charge generation layer 3 and the charge transport layer 4 and that the intermediate layer 2 and the protective layer 5 are arranged as required.

In the photoreceptor of the present invention, it is important that the charge transport layer 4 contains at least a hole-transporting substance, an electron-transporting substance and a binder resin; that the mass ratio ($R_{PN}$) [% by mass] between the mass (P) of the hole-transporting substance and the mass (N) of the electron-transporting substance, which is represented by the following equation (1), satisfy the following equation (2); and that, when a voltage of +6 kV is applied to the photoreceptor for 5 seconds via a resin sheet having a thickness of 50 μm and a surface resistivity of $2\times10^7$ Ω/cm$^2$, the surface potential difference (ΔVo) and half-tone potential difference (ΔVh) between before and after the voltage application be both 15 V or less:

$$R_{PN}=(N/(P+N))\times100 \quad (1)$$

$$1\leq R_{PN}\leq40 \quad (2)$$

According to the present invention, by not only specifying the ratio of the functional materials in the charge transport layer 4 but also specifying the potential characteristics in voltage application via a resin sheet under prescribed conditions, the generation of charge memory in the photoreceptor, which is caused by triboelectric charging and the like at the time of package opening, can be inhibited regardless of the material of the protective member used for packaging. In the present invention, the details of the mechanism by which the generation of charge memory is inhibited are not clear; however, the mechanism is presumed as follows.

That is, when an ordinary negatively-chargeable laminate-type electrophotographic photoreceptor is positively charged, electrons for neutralization of the positive charge of the surface cannot move through a charge transport layer and, consequently, the positive charge is not reduced and thus remains on the surface. When the negatively-chargeable laminate-type electrophotographic photoreceptor is negatively charged in this state, neutralization takes place between electrons and the positive charge remaining in the positively charged part and the charge is thus reduced to below a prescribed value. This appears in the form of image unevenness.

However, the negatively-chargeable laminate-type electrophotographic photoreceptor of the present invention comprises a hole-transporting substance and an electron-transporting substance in the charge transport layer; therefore, electrons generated in the charge generation layer are allowed to move in the charge transport layer and the positive charge of the surface is gradually cancelled by electrons and thus reduced. Accordingly, even if a positive charge is imparted to the surface due to triboelectric charging or the like at the time of removing the protective member, since the surface potential of the positively charged part hardly changes when the photoreceptor is negatively charged, image unevenness so-called charge memory is not generated.

Further, the reason why the surface potential difference (ΔVo) and half-tone potential difference (ΔVh) between before and after application of a voltage of +6 kV to the photoreceptor for 5 seconds via a resin sheet having a thickness of 50 μm and a surface resistivity of $2\times10^7$ Ω/cm$^2$ are addressed in the present invention is as follows. That is, it is believed that the generation of charge memory is inhibited when the surface potential difference (ΔVo) and the half-tone potential difference (ΔVh) are both 15 V or less in a state where the voltage application is made via the resin sheet having conditions similar to those of a common protective member. The surface potential difference (ΔVo) and the half-tone potential difference (ΔVh) are both required to be 15 V or less, and they are preferably 10 V or less.

In the present invention, the surface potential difference (ΔVo) and half-tone potential difference (ΔVh) between before and after application of a positive voltage to the photoreceptor via a resin sheet can be measured in accordance with a conventional method, and the measurement is performed as follows.

First, using a general-purpose photoreceptor electrical properties testing apparatus, the subject photoreceptor is charged with a surface potential (Vo) of −600 V while adjusting the applied voltage by a scorotron charging method under an environment having a temperature of 23° C. and a relative humidity of 50%. Then, using a monochromatic light spectrally resolved at 780 nm, the photoreceptor is sequentially exposed while changing the exposure dose, and the surface potential is measured at each exposure dose. From the resulting light attenuation curve, the exposure dose required for the half-tone potential (Vh) to reach −300 V is determined as the sensitivity E1/2 ($\mu J/cm^2$).

Next, a 50 μm-thick rectangular resin sheet (surface resistivity: $2\times10^7$ $\Omega/cm^2$) is press-fixed on the photoreceptor surface such that one end of the resin sheet is tightly adhered to the photoreceptor surface. As the resin sheet, any resin sheet can be used as long as it satisfies the above-described conditions of thickness and surface resistivity, and specific examples thereof include a black conductive resin sheet in which carbon black is incorporated into a polyethylene resin or a polypropylene resin; a black conductive paper obtained by kneading carbon black into a kraft paper; and a black sheet obtained by applying conductive coating to a base material such as a resin sheet or paper. Subsequently, after connecting the output terminal of a high-voltage power supply to the other end of the resin sheet and a ground wire to the substrate of the photoreceptor, a voltage of +6 kV is applied for 5 seconds in the dark.

Thereafter, within 10 minutes after the application of +6 kV voltage, using a general-purpose photoreceptor electrical properties testing apparatus, the photoreceptor is charged under an environment having a temperature of 23° C. and a relative humidity of 50% with the voltage applied in the evaluation of initial electrical properties being adjusted by a scorotron charging method. The surface potential profile equivalent to 5 circumferences of the photoreceptor is measured, and the average value of the surface potential at 5 spots in the part subjected to the application of +6 kV voltage is determined and defined as the post-voltage application surface potential, Vo1.

Further, in the same manner, the photoreceptor in a charged state is irradiated with an exposure light adjusted to have an initial exposure dose of E1/2 ($\mu J/cm^2$). The potential profile equivalent to 5 circumferences of the photoreceptor is measured in the same manner, and the average value of the half-tone potential at 5 spots in the part subjected to the application of +6 kV voltage is determined and defined as the post-voltage application half-tone potential, Vh1.

Based on the thus obtained results, the surface potential difference (ΔVo) and half-tone potential difference (ΔVh) between before and after the voltage application are determined using the following equations (a) and (b), respectively:

$$\text{Surface potential difference: } \Delta Vo=|Vo-Vo1| \quad (a)$$

$$\text{Half-tone potential difference: } \Delta Vh=|Vh-Vh1| \quad (b)$$

In the present invention, as long as the ratio of the functional materials relating to the charge transport layer 4 and the prescribed potential characteristics are satisfied, the expected effects of the present invention can be attained, and the concrete constitutions of the respective layers of the photoreceptor are not particularly restricted.

(Conductive Substrate)

In the present invention, the conductive substrate 1 not only functions as an electrode of the photoreceptor but also serves as a support of other layers at the same time. The conductive support 1 may take any of a cylindrical form, a plate form and a film form; however, it generally takes a cylindrical form. As the material thereof, for example, a metal such as a known aluminum alloy (e.g., JIS 3003 type, JIS 5000 type or JIS 6000 type), stainless steel or nickel or a glass or resin on which a conductive treatment is performed, can be used.

A substrate having a prescribed dimensional accuracy can be obtained by performing an extrusion or drawing process in the case of an aluminum alloy or by employing injection molding in the case of a resin. Further, as required, the surface of the substrate can be processed to a more appropriate roughness, for example, by machining with a diamond bit. Thereafter, the surface of the substrate is cleaned by degreasing and washing with an aqueous detergent such as a weak alkaline detergent.

(Intermediate Layer)

On the surface of the conductive substrate cleaned in the above-described manner, the intermediate layer 2 can be arranged as required.

The intermediate layer is composed of, for example, a layer containing a resin as a main component or an oxide film of alumite or the like, and it is arranged as required for the purposes of inhibiting the injection of unnecessary charge from the conductive substrate to the charge generation layer, covering defects on the substrate surface, improving the adhesion of the charge generation layer and the like.

As a binder resin, for example, polycarbonate resins, polyester resins, polyvinyl acetal resins, polyvinyl butyral resins, polyvinyl alcohol resins, vinyl chloride resins, vinyl acetate resins, polyethylenes, polypropylenes, acrylic resins, polyurethane resins, epoxy resins, melamine resins, silicon resins, polyamide resins, polystyrene resins, polyacetal resins, polyallylate resins, polysulfone resins, methacrylate polymers, and copolymers thereof can be used individually or in an appropriate combination of two or more thereof. Further, a mixture of resins of the same kind but with different molecular weights can also be used.

The binder resin may also contain, for example, fine particles of a metal oxide such as silicon oxide, titanium oxide, zinc oxide, calcium oxide, aluminum oxide or zirconium oxide, fine particles of a metal sulfate such as barium sulfate or calcium sulfate, fine particles of a metal nitride such as silicon nitride or aluminum nitride, an organometallic compound, a silane coupling agent, and/or a substance formed from an organometallic compound and a silane coupling agent. The content of these materials can be arbitrarily set within a range that allows layer formation.

In cases where the intermediate layer contains a resin as a main component, a hole-transporting substance or an electron-transporting substance can be incorporated thereinto for the purposes of, for example, imparting charge transport properties and reducing charge trap. The content of the hole-transporting substance or electron-transporting substance is preferably 0.1 to 60% by mass, more preferably 5 to 40% by mass, with respect to the solid content of the intermediate layer. Further, as required, other known additive(s) may also be incorporated within a range that does not markedly impair the electrophotographic properties.

The intermediate layer may be a single layer, or two or more layers of different kinds may be laminated and used as the intermediate layer. Although the thickness of the intermediate layer is dependent on the composition of the intermediate layer, it can be set arbitrarily within a range where there is no adverse effect such as an increase in the residual potential when the photoreceptor is repeatedly and continuously used, and the thickness of the intermediate layer is preferably 0.1 to 10 μm.

(Charge Generation Layer)

The charge generation layer 3 is arranged on the intermediate layer 2. The charge generation layer 3 usually contains a charge-generating material and a binder resin.

The charge-generating material is not particularly restricted as long as it is a material that is photosensitive to the wavelength of an exposure light source and, for example, an organic pigment conductive material such as a phthalocyanine pigment, an azo pigment, a quinacridone pigment, an indigo pigment, a perylene pigment, a polycyclic quinone pigment, an anthanthrone pigment or a benzimidazole pigment can be used. The charge generation layer 3 can be formed by applying a coating liquid, which is prepared by dispersing or dissolving such a charge-generating material in, for example, a binder resin such as a polyester resin, a polyvinyl acetate resin, a polymethacrylate resin, a polycarbonate resin, a polyvinyl butyral resin or a phenoxy resin, on the intermediate layer 2.

The content of the charge-generating material in the charge generation layer is preferably 20 to 80% by mass, more preferably 30 to 70% by mass, with respect to the solid content in the charge generation layer. Further, the content of the binder resin in the charge generation layer is preferably 20 to 80% by mass, more preferably 30 to 70% by mass, with respect to the solid content in the charge generation layer. The thickness of the charge generation layer is usually 0.1 μm to 0.6 μm.

(Charge Transport Layer)

A photoreceptor is obtained by arranging the charge transport layer 4 on the charge generation layer 3.

As described above, it is required that the charge transport layer 4 of the present invention be mainly constituted by a hole-transporting substance, an electron-transporting substance and a binder resin; and that the mass ratio ($R_{PN}$) [% by mass] between the mass (P) of the hole-transporting substance and the mass (N) of the electron-transporting substance, which is represented by the following equation (1), satisfy the following equation (2). By controlling the ratio of the hole-transporting substance and the electron-transporting substance in the charge transport layer 4 to be in the below-described range, the generation of charge memory can be effectively inhibited while maintaining an appropriate sensitivity.

$$R_{PN}=(N/(P+N))\times 100 \quad (1)$$

$$1\leq R_{PN}\leq 40 \quad (2)$$

When the mass ratio ($R_{PN}$) is lower than 1% by mass, sufficient effect cannot be obtained for the intended inhibition of charge memory, whereas when the mass ratio ($R_{PN}$) is higher than 40% by mass, its side effect causes an increase in the residual potential and the electrophotographic properties are thereby deteriorated; therefore, the effects of the present invention cannot be attained in either of these cases. Further, the mass ratio ($R_{PN}$) satisfies preferably the following equation (3), more preferably the following equation (4):

$$2\leq R_{PN}\leq 30 \quad (3)$$

$$5\leq R_{PN}\leq 20 \quad (4)$$

As the hole-transporting substance constituting the charge transport layer 4, widely used hole-transporting substances, such as hydrazone compounds, pyrazoline compounds, pyrazolone compounds, oxadiazole compounds, oxazole compounds, arylamine compounds, benzidine compounds, stilbene compounds, styryl compounds, enamine compounds, butadiene compounds, polyvinyl carbazoles and polysilanes, can be used individually or in an appropriate combination of two or more thereof.

Further, as the electron-transporting substance constituting the charge transport layer 4, it is preferred that at least one of the compounds represented by the above-described Formulae (ET1) to (ET3) be incorporated. As the electron-transporting substance, in addition thereto, other electron-transporting substances (acceptor compounds) such as succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compounds, quinone compounds, benzoquinone compounds, diphenoquinone compounds, naphthoquinone compounds, azoquinone compounds, anthraquinone compounds, diiminoquinone compounds and stilbenequinone compounds can also be used individually or in an appropriate combination of two or more thereof.

Specific examples of the compound represented by the Formula (ET1) that can be used in the present invention include, but not limited to, the following compounds.

(ET1-1)

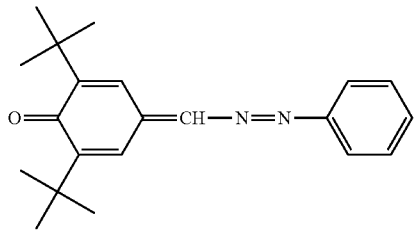

(ET1-2)

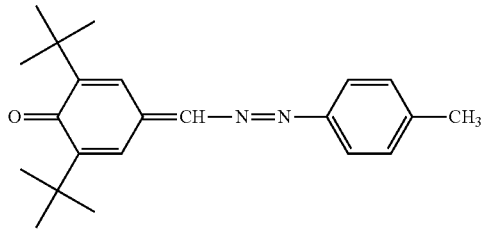

(ET1-3)

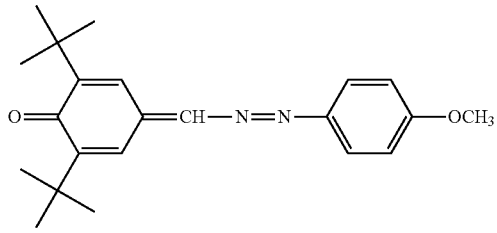

-continued
(ET1-4)
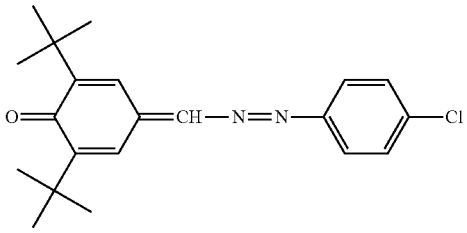
(ET1-5)
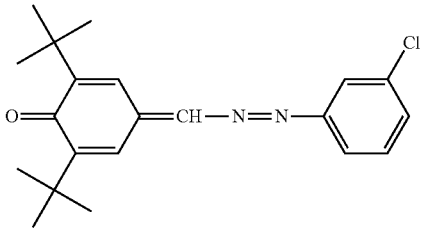
(ET1-6)
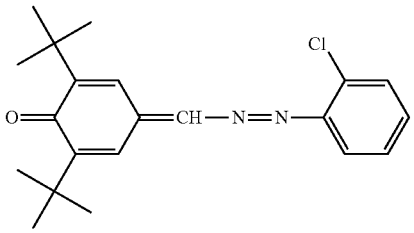
(ET1-7)
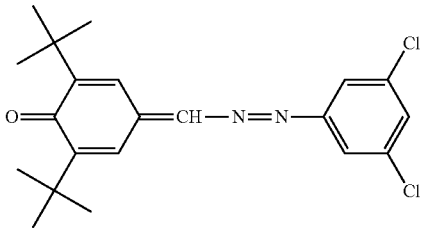
(ET1-8)
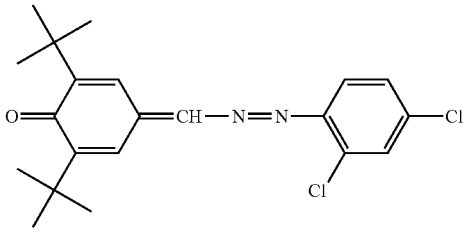
(ET1-9)
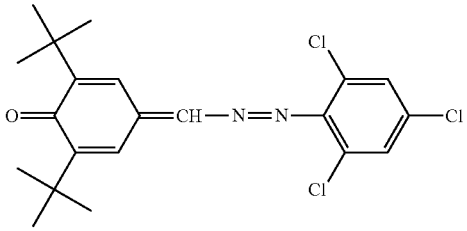
-continued
(ET1-10)
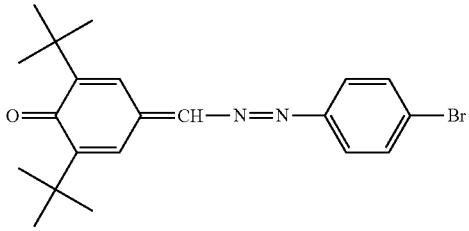
(ET1-11)
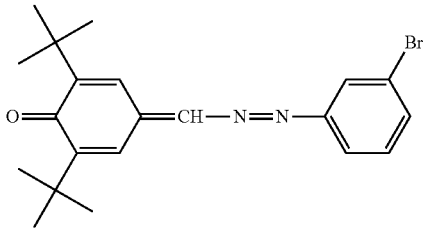
(ET1-12)
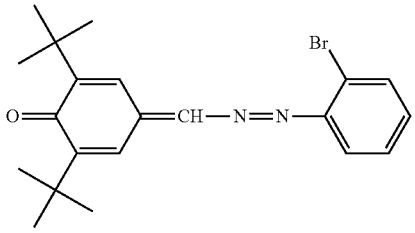
(ET1-13)
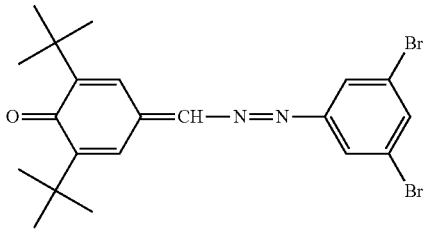
(ET1-14)
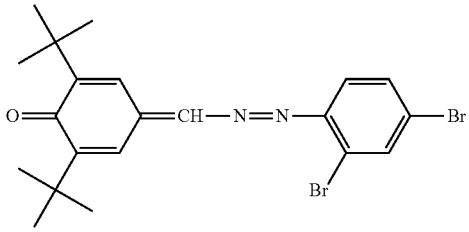
(ET1-15)
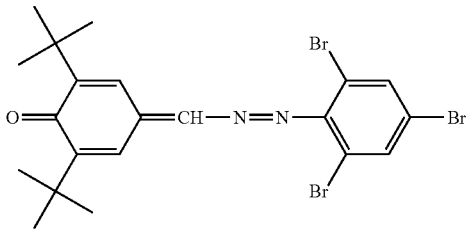

-continued
(ET1-16)
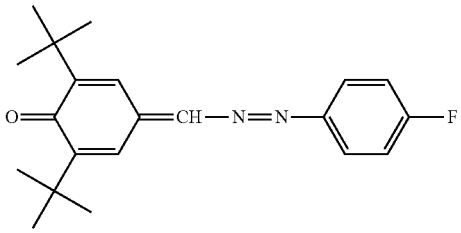
(ET1-17)
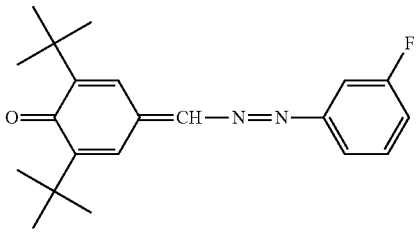
(ET1-18)
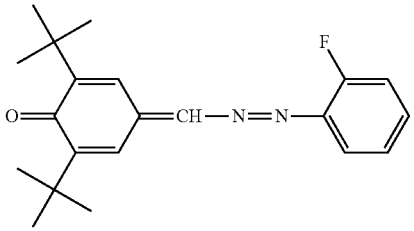
(ET1-19)
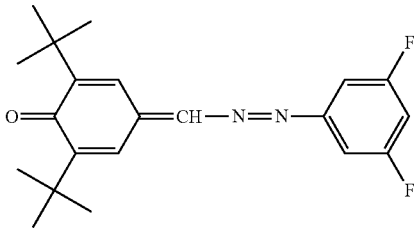
(ET1-20)
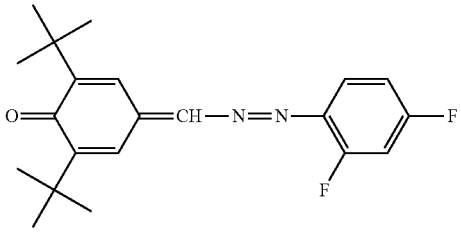
(ET1-21)
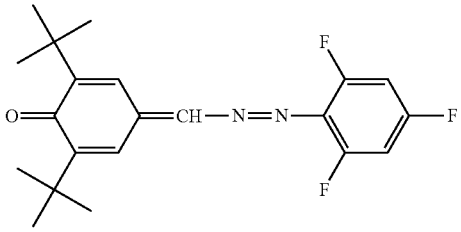
-continued
(ET1-22)
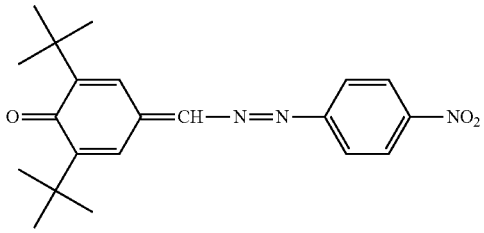
(ET1-23)
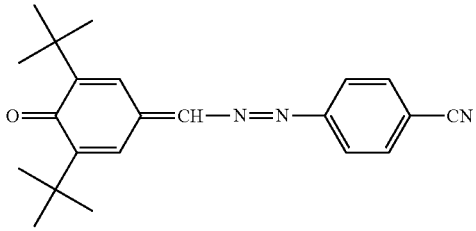
(ET1-24)
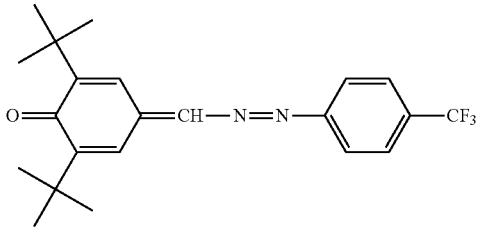
(ET1-25)
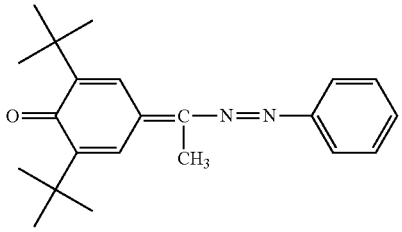
(ET1-26)
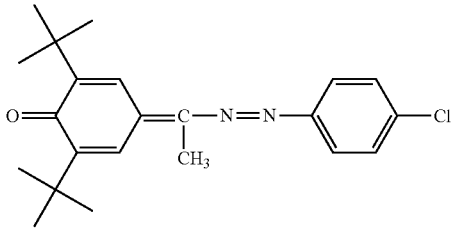
(ET1-27)
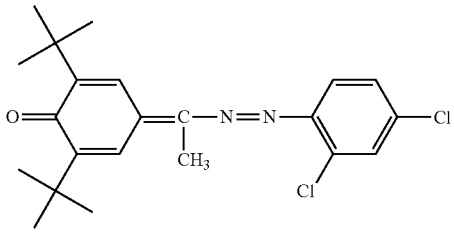

-continued
(ET1-28)
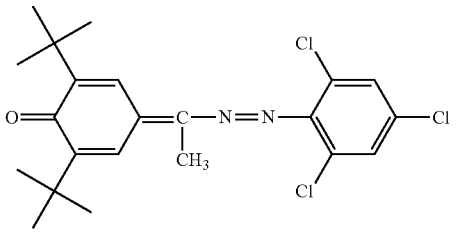
(ET1-29)
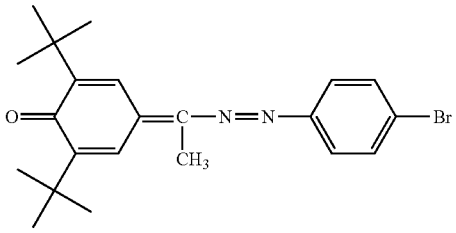
(ET1-30)
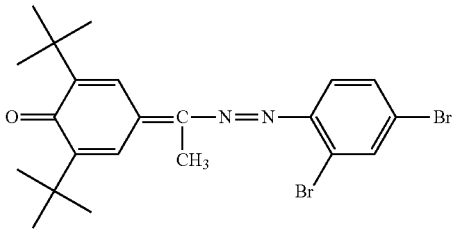
(ET1-31)
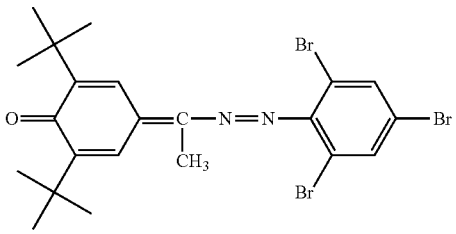
(ET1-32)
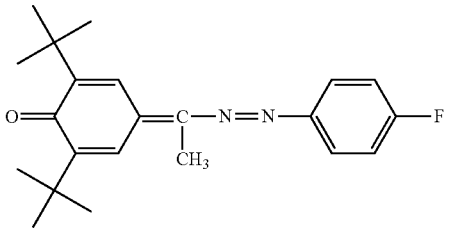
(ET1-33)
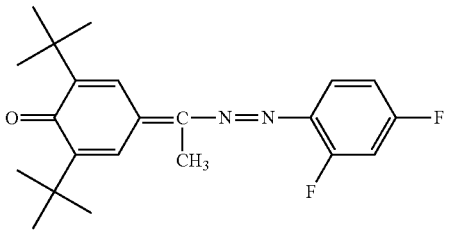
-continued
(ET1-34)
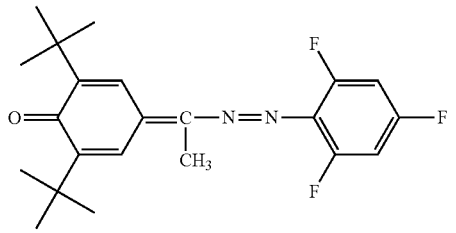
(ET1-35)
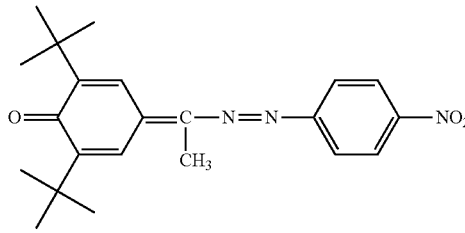
(ET1-36)
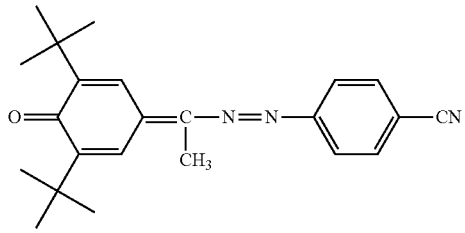
(ET1-37)
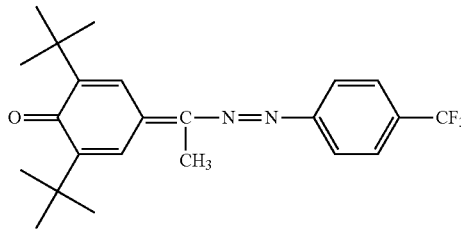
(ET1-38)
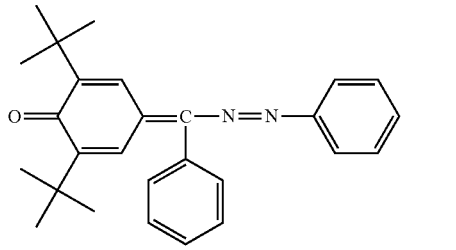
(ET1-39)
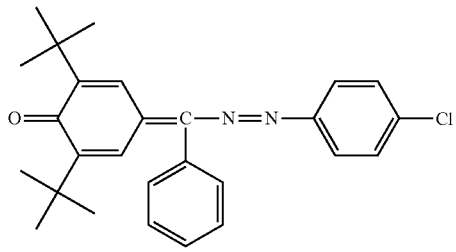

-continued
(ET1-40)
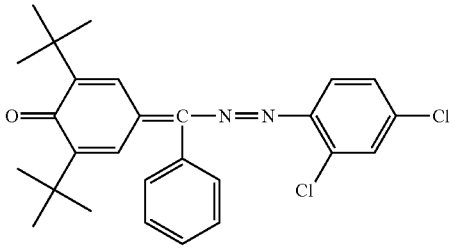
(ET1-41)
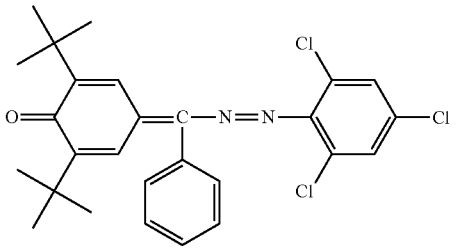
(ET1-42)
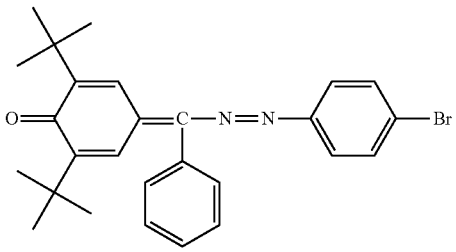
(ET1-43)
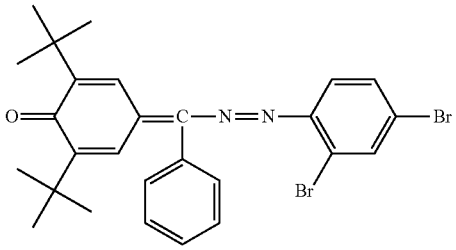
(ET1-44)
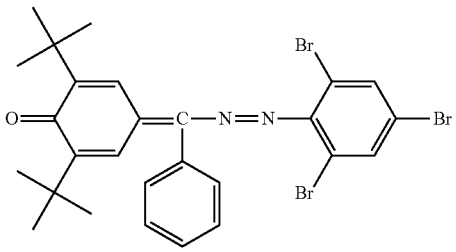
-continued
(ET1-45)
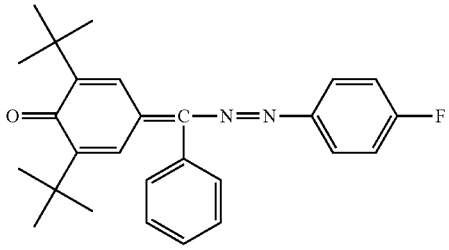
(ET1-46)
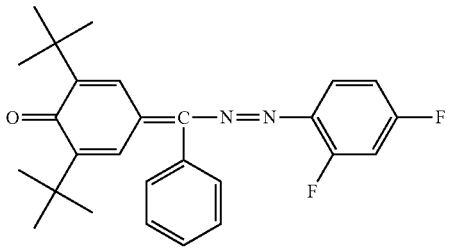
(ET1-47)
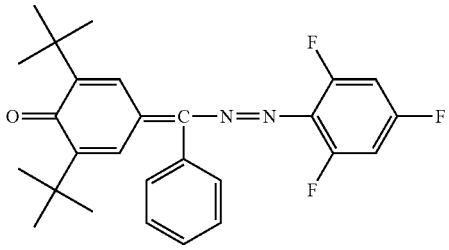
(ET1-48)
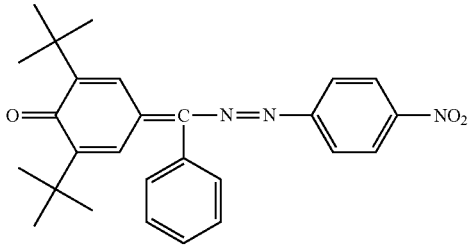
(ET1-49)
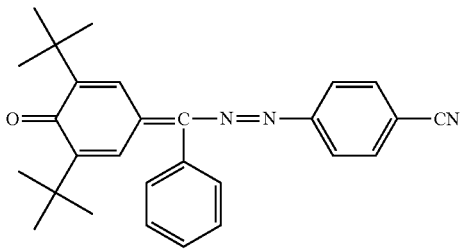

-continued
(ET1-50)
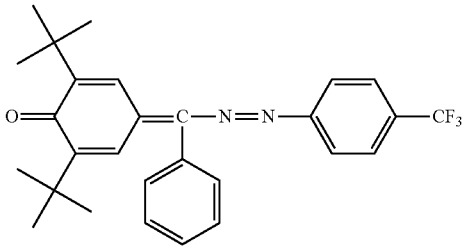
(ET1-51)
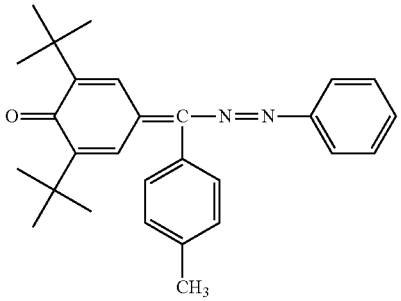
(ET1-52)
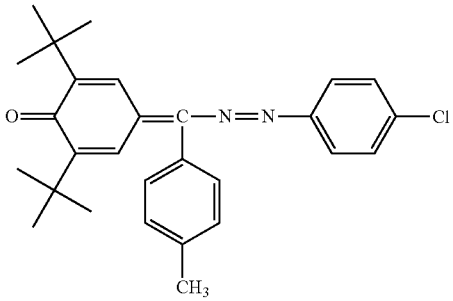
(ET1-53)
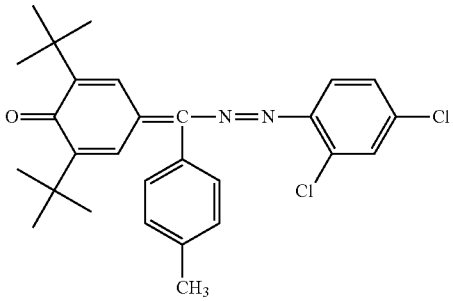
(ET1-54)
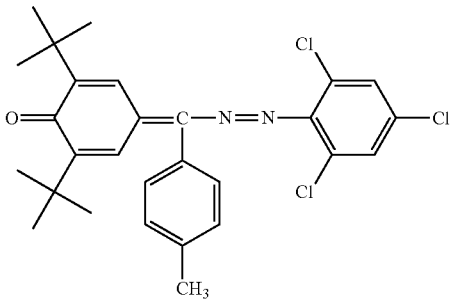
-continued
(ET1-55)
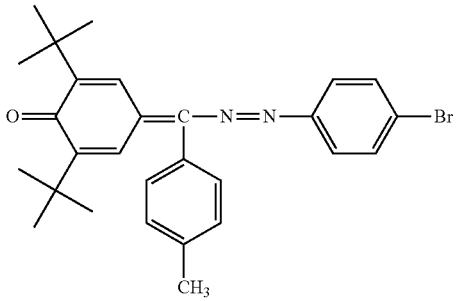
(ET1-56)
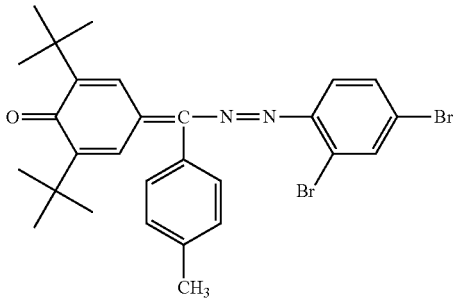
(ET1-57)
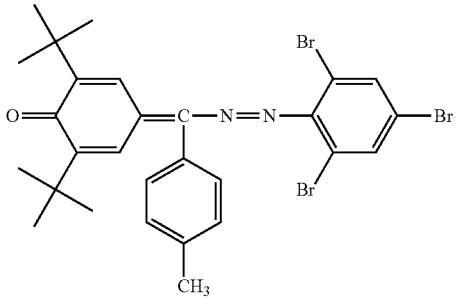
(ET1-58)
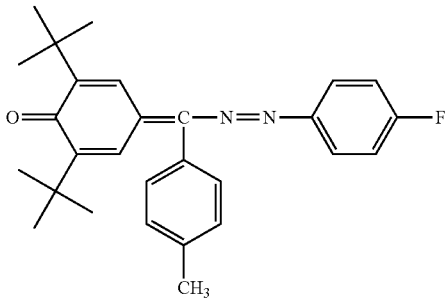
(ET1-59)
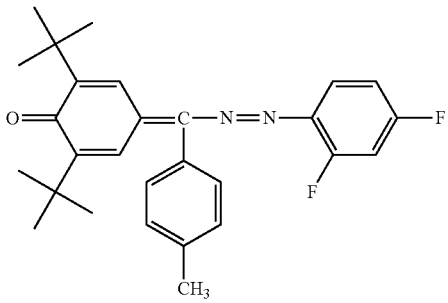

-continued
(ET1-60)
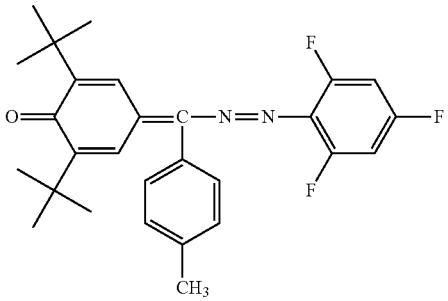
(ET1-61)
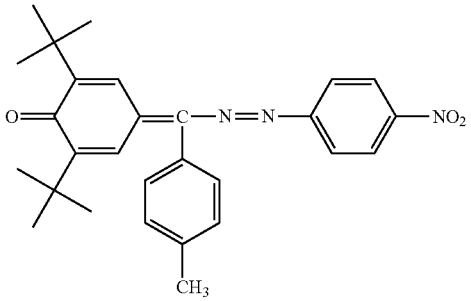
(ET1-62)
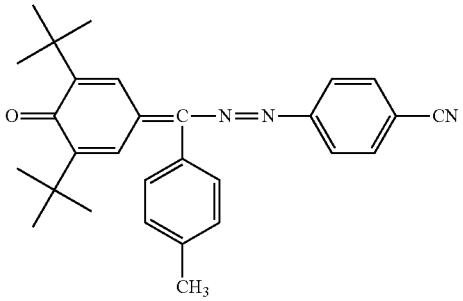
(ET1-63)
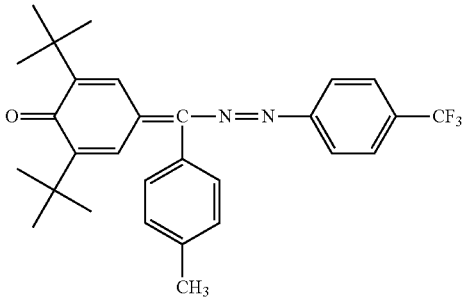
(ET1-64)
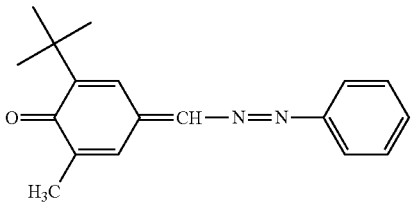
-continued
(ET1-65)
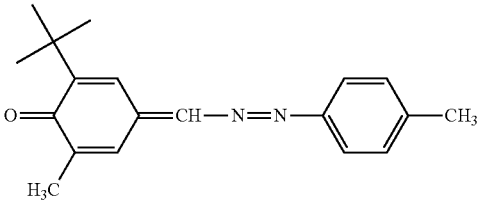
(ET1-66)
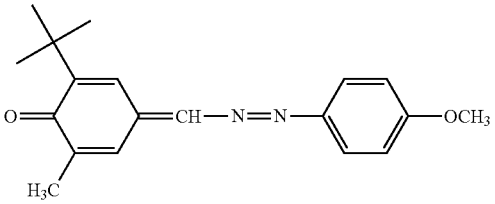
(ET1-67)
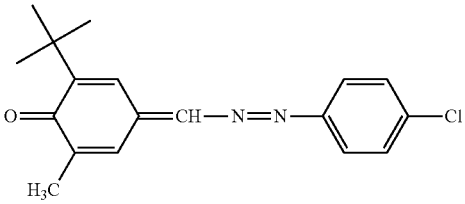
(ET1-68)
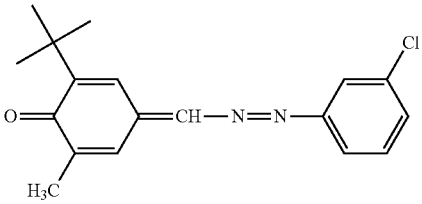
(ET1-69)
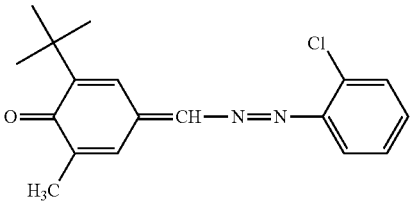
(ET1-70)
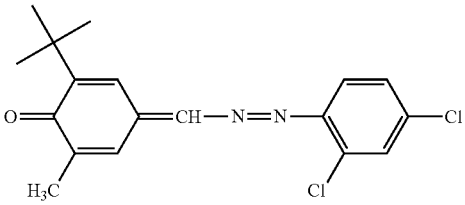
(ET1-71)
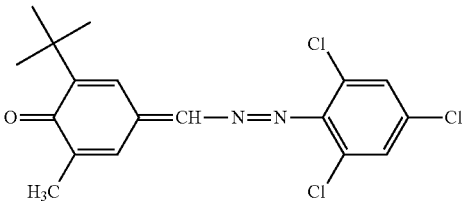

-continued (ET1-72)

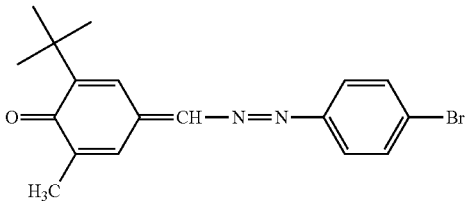

(ET1-73)

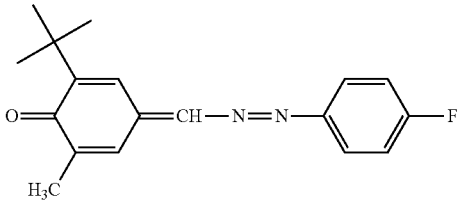

(ET1-74)

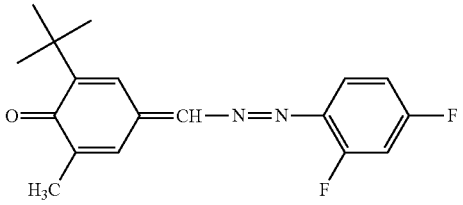

(ET1-75)

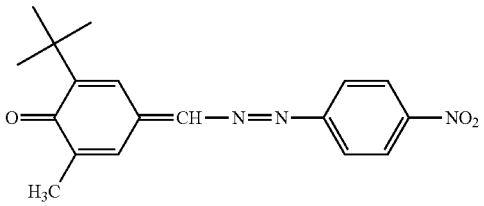

(ET1-76)

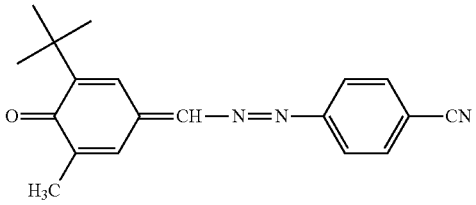

(ET1-77)

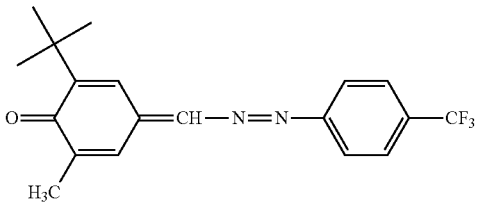

Specific examples of the compound represented by the Formula (ET2) that can be used in the present invention include, but not limited to, the following compounds. In the Formula (ET2), the substituent $R_{14}$ is preferably an aryl group substituted with a halogen group such as a chloro group since such a compound has high electron-transporting ability.

(ET2-1)

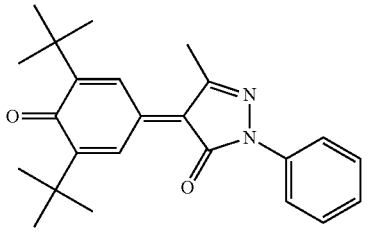

(ET2-2)

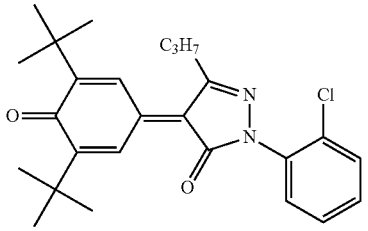

(ET2-3)

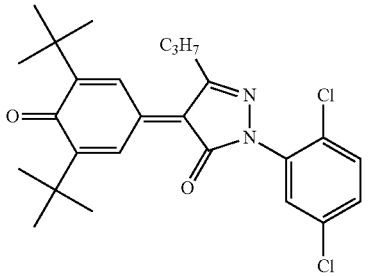

(ET2-4)

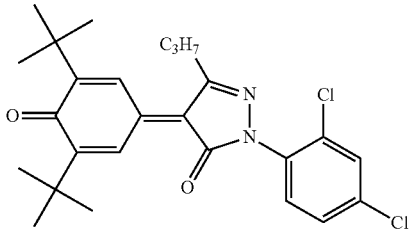

(ET2-5)

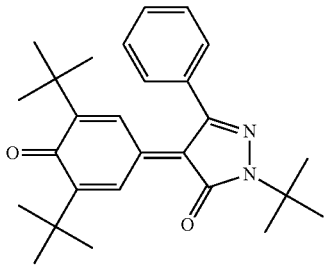

(ET2-6)

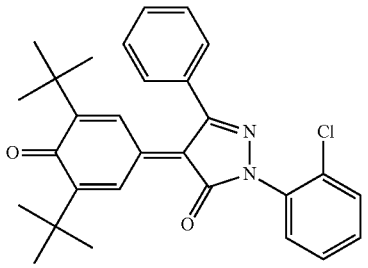

-continued
(ET2-7)
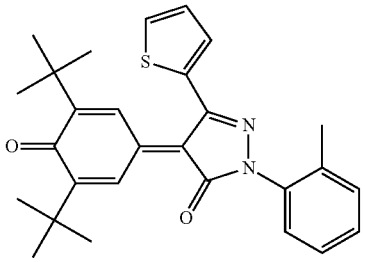
(ET2-8)
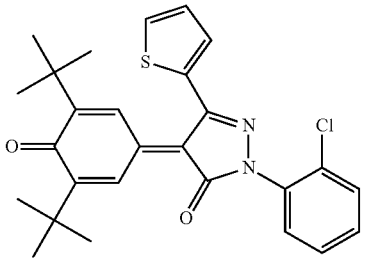
(ET2-9)
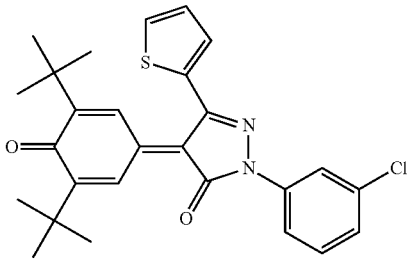
(ET2-10)
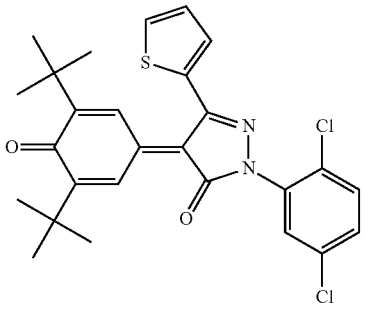
(ET2-11)
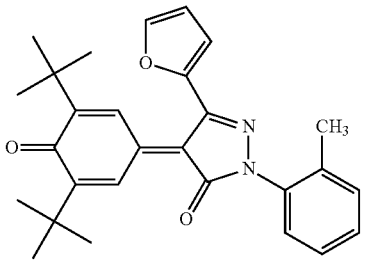
-continued
(ET2-12)
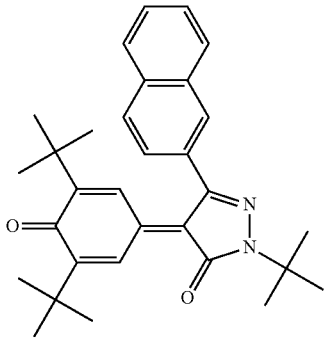
(ET2-13)
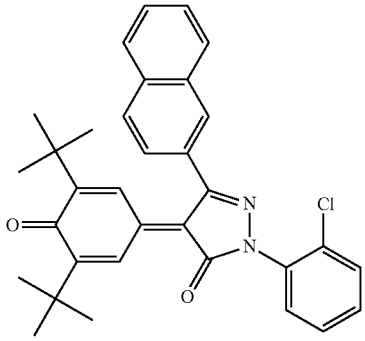
Specific examples of the compound represented by the Formula (ET3) that can be used in the present invention include, but not limited to, the following compounds.
(ET3-1)
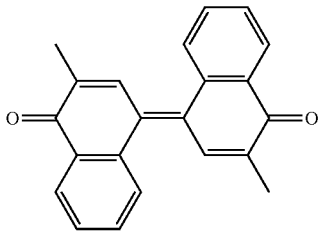
(ET3-2)
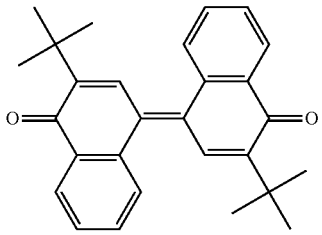
(ET3-3)
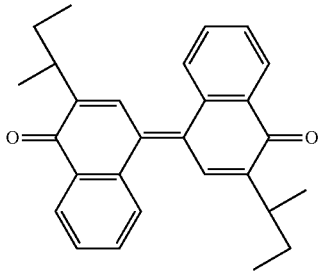

-continued (ET3-4)

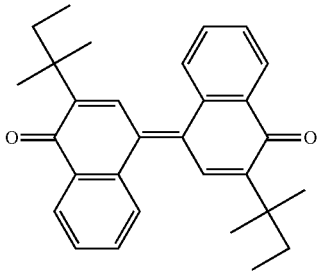

(ET3-5)

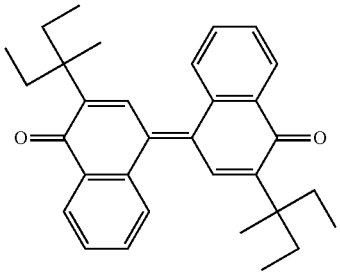

(ET3-6)

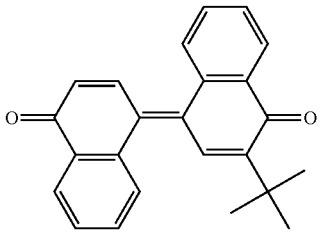

(ET3-7)

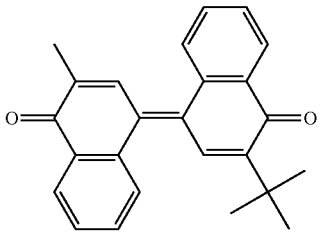

(ET3-8)

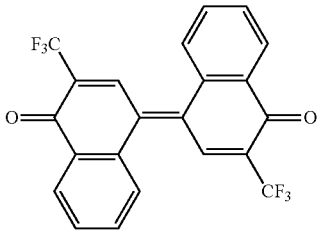

(ET3-9)

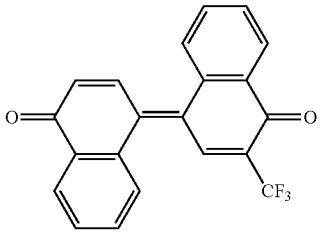

-continued (ET3-10)

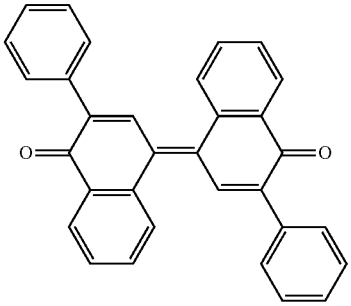

(ET3-11)

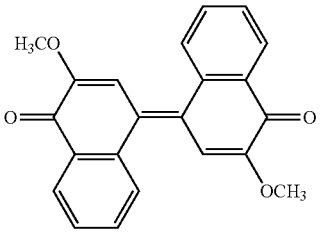

(ET3-12)

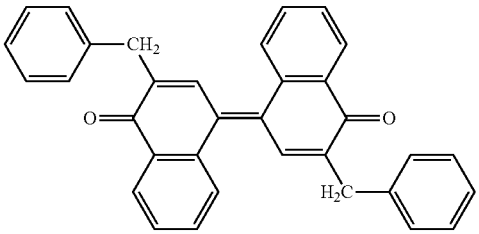

(ET3-13)

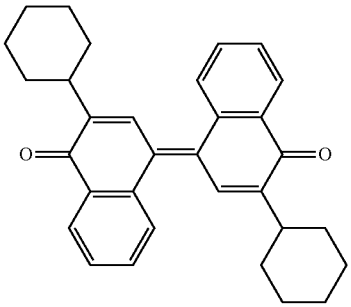

The binder resin constituting the charge transport layer is not particularly restricted, and any binder resin known in the art may be used. For example, thermoplastic resins such as polycarbonate resins, polyallylate resins, polyester resins, polyvinyl acetal resins, polyvinyl butyral resins, polyvinyl alcohol resins, vinyl chloride resins, vinyl acetate resins, polyethylene resins, polypropylene resins, polystyrene resins, acrylic resins, polyamide resins, ketone resins, polyacetal resins, polysulfone resins and methacrylate polymers; thermosetting resins such as alkyd resins, epoxy resins, silicon resins, urea resins, phenol resins, unsaturated polyester resins, polyurethane resins and melamine resins; and copolymers of these resins can be used individually or in an appropriate combination of two or more thereof.

In the charge transport layer, in order to improve the environmental resistance and the stability against damaging light, a deterioration inhibitor(s) such as an antioxidant, a radical capturing agent, a singlet quencher and/or a UV absorber can also be incorporated. Examples of a compound used for this purpose include chromanol derivatives such as tocopherol, as well as esterified compounds, polyarylalkane compounds, hydroquinone derivatives, etherified compounds, dietherified compounds, benzophenone derivatives, benzotriazole derivatives, thioether compounds, phenylenediamine derivatives, phosphonates, phosphites, phenolic compounds, hindered phenol compounds, linear amine compounds, cyclic amine compounds, hindered amine compounds and biphenyl derivatives.

Further, in the charge transport layer, for the purposes of improving the leveling of the resulting film and imparting lubricity, a leveling agent such as silicone oil or fluorocarbon oil can also be incorporated. Moreover, for the purposes of reducing the frictional coefficient, imparting lubricity and the like, for example, fine particles of a metal oxide (e.g., silicon oxide (silica), titanium oxide, zinc oxide, calcium oxide, aluminum oxide (alumina) or zirconium oxide), a metal sulfate (e.g., barium sulfate or calcium sulfate) or a metal nitride (e.g., silicon nitride or aluminum nitride), particles of a fluorocarbon resin such as tetrafluoroethylene resin or particles of a comb-type fluorine-containing graft polymer resin may also be incorporated.

The content of the binder resin in the charge transport layer is preferably 20 to 90% by mass, more preferably 30 to 80% by mass, with respect to the solid content of the charge transport layer. Further, the total content of the hole-transporting substance and the electron-transporting substance in the charge transport layer is preferably 10 to 80% by mass, more preferably 20 to 70% by mass, with respect to the solid content of the charge transport layer. In order to maintain a practically effective surface potential, the thickness of the charge transport layer is preferably 5 to 60 μm, more preferably 10 to 40 μm.

(Protective Layer)

The protective layer 5 can be arranged as required for the purpose of improving the printing durability and the like, and the protective layer 5 is composed of a layer containing a binder resin as a main component or an inorganic thin film of amorphous carbon or the like. In the binder resin, for the purposes of improving the conductivity, reducing the frictional coefficient, imparting lubricity and the like, for example, fine particles of a metal oxide such as silicon oxide, titanium oxide, zinc oxide, calcium oxide, aluminum oxide or zirconium oxide, a metal sulfate such as barium sulfate or calcium sulfate, or a metal nitride such as silicon nitride or aluminum nitride; particles of a fluorocarbon resin such as tetrafluoroethylene resin; or particles of a comb-type fluorine-containing graft polymer resin may be incorporated.

Further, it is also possible to incorporate the hole-transporting substance and electron-transporting substance used in the charge generation layer and charge transport layer for the purpose of imparting charge transport properties and to incorporate a leveling agent such as silicone oil or fluorocarbon oil for the purposes of improving the leveling of the resulting film and imparting lubricity. Moreover, as required, other known additive(s) may also be incorporated within a range that does not markedly impair the electrophotographic properties.

Although the thickness of the protective layer itself is dependent on the composition of the surface protective layer, it can be set arbitrarily within a range where there is no adverse effect such as an increase in the residual potential when the photoreceptor is repeatedly and continuously used.

(Electrophotographic Apparatus)

Figure 2:
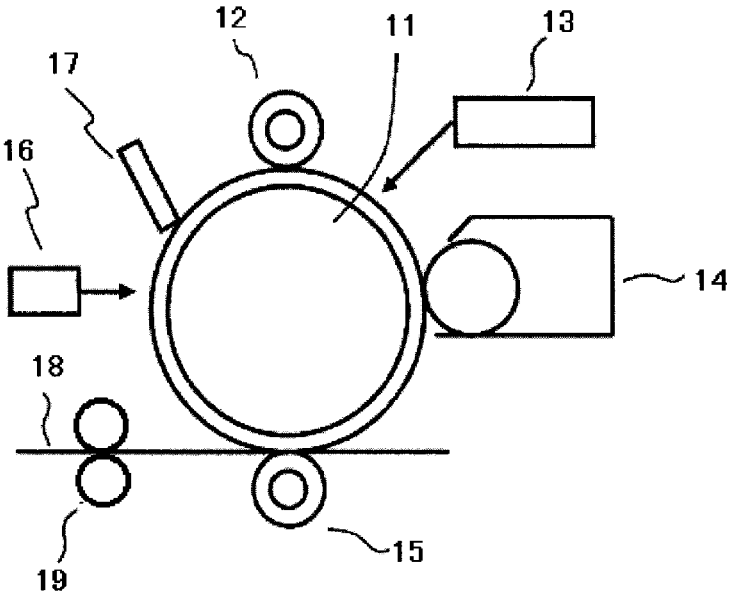
FIG. 2 is a schematic structural view showing one example of the electrophotographic apparatus of the present invention.

FIG. 2 is a schematic structural view showing one example of the electrophotographic apparatus of the present invention. The electrophotographic apparatus of the present invention shown in FIG. 2 comprises: a photoreceptor 11 of the present invention; a charging means 12, which charges the photoreceptor 11; an exposure means 13, which exposes the thus charged photoreceptor to form an electrostatic latent image; a developing means 14, which develops the electrostatic latent image formed on the photoreceptor with a toner to form a toner image; a transfer means 15, which transfers the toner image formed on the photoreceptor to a recording medium 18 such as a sheet of paper; and a fixation means 19, which fixes the toner image transferred to the recording medium 18.

The expected effects of the electrophotographic photoreceptor of the present invention can be attained by applying the electrophotographic receptor to various machine processes. Specifically, for instance, as the charging means 12, charging apparatuses and charging processes, examples of which include contact charging systems using a charging member such as a roller as shown in FIG. 2 or a brush and non-contact charging systems using a charging member such as a corotron or a scorotron, can be applied. Further, as the developing means 14, developing apparatuses and developing processes, examples of which include contact development and non-contact development systems based on a developing method (developer) using a single non-magnetic component, a single magnetic component, two components or the like, can be applied, and sufficient effects can be attained in any of these processes.

Further, as the exposure means 13, for example, a laser optical system for exposure can be used and, as the transfer means 15, for example, such a transfer roller as shown in FIG. 2 can be used. In FIG. 2, the symbol 16 represents a light source for charge removal and the symbol 17 represents a cleaning means such as a cleaning blade. The electrophotographic apparatus of the present invention can be a color printer.

(Package)

The package of the present invention is a package in which the above-described photoreceptor of the present invention is covered with a black sheet article, the package being characterized in that the black sheet article has a thickness of 30 to 80 μm and a surface resistivity of $10^2$ to $10^{11}$ $\Omega/cm^2$. Such a package in which the photoreceptor is covered with a sheet article having a specific thickness and a specific surface resistivity enables to inhibit the generation of charge memory in the photoreceptor while protecting the photoreceptor in an inexpensive manner.

The black sheet article may be any black sheet article as long as it has the above-described specific thickness and surface resistivity, and the material and the like thereof are not particularly restricted. Specifically, for example, a black conductive resin sheet in which carbon black is incorporated into a polyethylene resin or polypropylene resin, a black conductive paper obtained by kneading carbon black into a kraft paper, or a black sheet obtained by applying conductive coating to a base material such as a resin sheet or paper can be used. The combination of such a black sheet article having the above-described specific thickness and surface resistivity and the photoreceptor enables to inhibit damage and deterioration of the photoreceptor without any problem of charge memory. When the thickness of the black sheet article is excessively small, the photoreceptor-protecting performance is insufficient, whereas when the black sheet article is excessively thick, the cost is increased and the package opening property is impaired without any additional effect. Further, a black sheet article having a low surface resistivity leads to an increased cost since it is generally difficult to prepare such a sheet article, whereas a black sheet article having an excessively high surface resistivity bears a charge and thus aggravates the problem of charge memory in the photoreceptor. The black sheet article has a thickness of preferably 40 to 60 μm and a surface resistivity of preferably $10^4$ to $10^8$ Ω/cm$^2$.

EXAMPLES

The present invention will now be described in detail by way of examples thereof. As long as the present invention does not depart from the gist thereof, the present invention is not restricted to the following examples.

Example 1

In a coating liquid for the formation of an intermediate layer, which was prepared by dissolving or dispersing 15 parts by mass of p-vinylphenol resin (trade name: MARUKA LYNCUR MH-2, manufactured by Maruzen Petrochemical Co., Ltd.), 10 parts by mass of n-butylated melamine resin (trade name: U-VAN 2021, manufactured by Mitsui Chemicals, Inc.) and 75 parts by mass of aminosilane-treated titanium oxide fine particles in a mixed solvent of 750 parts by mass of methanol and 150 parts by mass of butanol, an aluminum alloy substrate having an outer diameter of 30 mm and a length of 255 mm was immersed and subsequently pulled out, thereby forming a coating film on the outer circumference of the substrate. This substrate was dried at a temperature of 130° C. for 30 minutes to form a 3 μm-thick intermediate layer.

Then, on the thus formed intermediate layer, a coating liquid for the formation of a charge generation layer, which was prepared by dispersing 15 parts by mass of Y-type titanyl phthalocyanine described in Japanese Unexamined Patent Application Publication No. S64-17066 (U.S. Pat. No. 4,898,799) as a charge-generating material and 15 parts by mass of polyvinyl butyral (S-LEC B BX-1, manufactured by Sekisui Chemical Co., Ltd.) as a binder resin in 600 parts by mass of dichloromethane for 1 hour using a sand mill disperser, was dip-coated. The resulting substrate was dried at a temperature of 80° C. for 30 minutes to form a 0.3 μm-thick charge generation layer.

Further, on the thus formed charge generation layer, a coating liquid for the formation of a charge transport layer, which was prepared by dissolving 72 parts by mass of a compound represented by the following structural formula (HT1) as a hole-transporting substance, 8 parts by mass of a compound represented by the above-described structural formula (ET1-4) as an electron-transporting substance and 120 parts by mass of a polycarbonate resin (IUPIZETA PCZ-500, manufactured by Mitsubishi Gas Chemical Company, Inc.) as a binder resin in 900 parts by mass of dichloromethane and subsequently adding thereto 0.1 parts by mass of silicone oil (KP-340, manufactured by Shin-Etsu Polymer Co., Ltd.), was dip-coated. The resulting substrate was dried at a temperature of 100° C. for 60 minutes to form a 25 μm-thick charge transport layer, thereby preparing an electrophotographic photoreceptor.

It is noted here that the mass ratio ($R_{PN}$) between the hole-transporting substance and the electron-transporting substance in this case was 10% by mass.

(HT1)

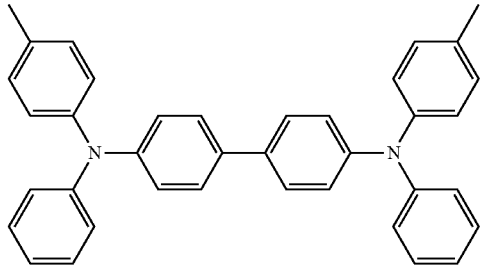

In the printing evaluation after the removal of a protective member, a black sheet article having a thickness of 50 μm and a surface resistivity of $2\times10^7$ Ω/cm$^2$ was used.

Examples 2 to 12, Comparative Examples 1 to 14 and Reference Example 1

Each electrophotographic photoreceptor was prepared in the same manner as in Example 1, except that the compounds used as the hole-transporting substance and electron-transporting substance of the charge transport layer and the amounts thereof were changed as shown in Table 1. In addition, the surface resistivity of the black sheet article used in the printing evaluation after the removal of a protective member was changed as shown in Table 1.

(HT2)

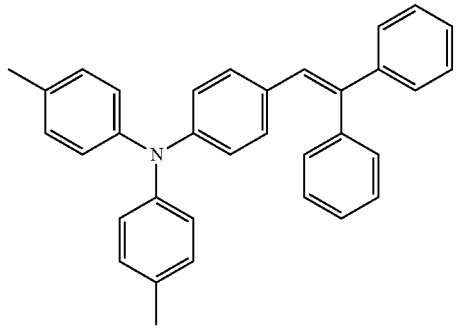

(ET4)

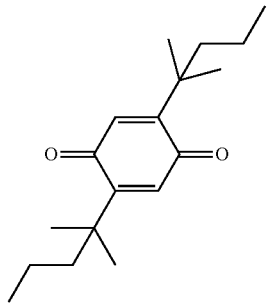

-continued (ET5)

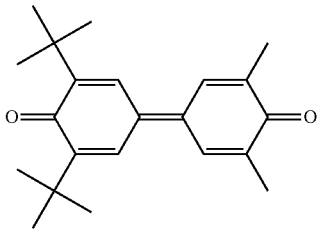

[Electrical Properties after Application of Positive Voltage]

Next, a rectangular conductive black polyethylene sheet (surface resistivity: $2\times10^7$ Ω/cm$^2$) having a thickness of 50 μm, a length of 60 mm and a width of 10 mm was press-fixed on the surface of each photoreceptor such that a 50-mm portion from one end of the sheet was tightly adhered to the photoreceptor surface. Subsequently, after connecting the output terminal of a high-voltage power supply MODEL 610C (manufactured by TREK, Inc.) to the other end of the conductive black polyethylene sheet and a ground wire to the substrate of the photoreceptor, a voltage of +6 kV was applied for 5 seconds in the dark.

TABLE 1

| | Hole-transporting substance (P) | | Electron transporting substance (N) | | Mass ratio | Surface resistivity of black |
|---|---|---|---|---|---|---|
| | Compound | Amount (parts by mass) | Compound | Amount (parts by mass) | $R_{PN}$ (% by mass) | sheet article (Ω/cm$^2$) |
| Example 1 | HT1 | 72 | ET1-4 | 8 | 10 | $2\times10^7$ |
| Example 2 | HT1 | 79.2 | ET1-4 | 0.8 | 1 | $2\times10^7$ |
| Example 3 | HT1 | 48 | ET1-4 | 32 | 40 | $2\times10^7$ |
| Example 4 | HT1 | 72 | ET2-3 | 8 | 10 | $2\times10^7$ |
| Example 5 | HT1 | 79.2 | ET2-3 | 0.8 | 1 | $2\times10^7$ |
| Example 6 | HT1 | 48 | ET2-3 | 32 | 40 | $2\times10^7$ |
| Example 7 | HT1 | 72 | ET3-4 | 8 | 10 | $2\times10^7$ |
| Example 8 | HT2 | 72 | ET2-3 | 8 | 10 | $2\times10^7$ |
| Example 9 | HT2 | 79.2 | ET2-3 | 0.8 | 1 | $2\times10^7$ |
| Example 10 | HT2 | 48 | ET2-3 | 32 | 40 | $2\times10^7$ |
| Example 11 | HT1 | 72 | ET1-4 | 8 | 10 | $3\times10^2$ |
| Example 12 | HT1 | 72 | ET1-4 | 8 | 10 | $1\times10^{11}$ |
| Comparative Example 1 | HT1 | 80 | — | 0 | 0 | $2\times10^7$ |
| Comparative Example 2 | HT1 | 79.36 | ET1-4 | 0.64 | 0.8 | $2\times10^7$ |
| Comparative Example 3 | HT1 | 40 | ET1-4 | 40 | 50 | $2\times10^7$ |
| Comparative Example 4 | HT1 | 79.36 | ET2-3 | 0.64 | 0.8 | $2\times10^7$ |
| Comparative Example 5 | HT1 | 40 | ET2-3 | 40 | 50 | $2\times10^7$ |
| Comparative Example 6 | HT2 | 80 | — | 0 | 0 | $2\times10^7$ |
| Comparative Example 7 | HT2 | 79.36 | ET2-3 | 0.64 | 0.8 | $2\times10^7$ |
| Comparative Example 8 | HT2 | 40.0 | ET2-3 | 40 | 50 | $2\times10^7$ |
| Comparative Example 9 | HT1 | 72 | ET4 | 8 | 10 | $2\times10^7$ |
| Comparative Example 10 | HT1 | 79.2 | ET4 | 0.8 | 1 | $2\times10^7$ |
| Comparative Example 11 | HT1 | 48 | ET4 | 32 | 40 | $2\times10^7$ |
| Comparative Example 12 | HT1 | 72 | ET5 | 8 | 10 | $2\times10^7$ |
| Comparative Example 13 | HT1 | 79.2 | ET5 | 0.8 | 1 | $2\times10^7$ |
| Comparative Example 14 | HT1 | 48 | ET5 | 32 | 40 | $2\times10^7$ |
| Reference Example 1 | HT1 | 72 | ET1-4 | 8 | 10 | $1\times10^{12}$ |

For the electrophotographic photoreceptors prepared in Examples 1 to 12, Comparative Examples 1 to 14 and Reference Example 1, the surface potential difference (ΔVo) and the half-tone potential difference (ΔVh) were evaluated by the below-described method. In addition, the residual potential, which is one of the initial electrical properties, as well as the image unevenness (charge memory) after the removal of a protective member were evaluated by the below-described methods.

[Initial Electrical Properties]

First, using a photoreceptor electrical properties testing apparatus CYNTHIA 93FE (manufactured by Gen-Tech, Inc.), each photoreceptor was charged with a surface potential (Vo) of −600 V while adjusting the applied voltage by a scorotron charging method under an environment having a temperature of 23° C. and a relative humidity of 50%. Then, using a halogen lamp as a light source, the photoreceptor was sequentially exposed to a monochromatic light spectrally resolved at 780 nm through a band-pass filter while changing the exposure dose, and the surface potential was measured at each exposure dose. From the resulting light attenuation curve, the exposure dose required for the half-tone potential (Vh) to reach −300 V was determined as the sensitivity E1/2 (μJ/cm$^2$).

Thereafter, within 10 minutes after the application of +6 kV voltage, using a photoreceptor electrical properties testing apparatus CYNTHIA 93FE (manufactured by Gen-Tech, Inc.), the photoreceptor was charged under an environment having a temperature of 23° C. and a relative humidity of 50% with the voltage applied in the evaluation of initial electrical properties being adjusted by a scorotron charging method. The surface potential profile equivalent to 5 circumferences of the photoreceptor was measured, and the average value of the surface potential at 5 spots in the part subjected to the application of +6 kV voltage was determined as Vo1.

Further, in the same manner, the photoreceptor in a charged state was irradiated with an exposure light adjusted to have an initial exposure dose of E1/2 (μ/cm$^2$). The potential profile equivalent to 5 circumferences of the photoreceptor was measured in the same manner, and the average value of the half-tone potential at 5 spots in the part subjected to the application of +6 kV voltage was determined and defined as the post-voltage application half-tone potential, Vh1.

Based on the thus obtained results, the surface potential difference (ΔVo) and half-tone potential difference (ΔVh)

between before and after the voltage application were determined using the following equations (a) and (b), respectively:.

$$\text{Surface potential difference: } \Delta Vo = |Vo - Vo1| \quad (a)$$

$$\text{Half-tone potential difference: } \Delta Vh = |Vh - Vh1| \quad (b)$$

[Measurement of Initial Residual Potential]

Using a photoreceptor electrical properties testing apparatus CYNTHIA 93FE (manufactured by Gen-Tech, Inc.), each photoreceptor was charged with a surface potential (Vo) of −600 V while adjusting the applied voltage by a scorotron charging method underan environment having a temperature of 23° C. and a relative humidity of 50%. Then, using a halogen lamp as a light source, the residual potential (Vr1) was measured when the photoreceptor was exposed to a monochromatic light spectrally resolved at 780 nm through a band-pass filter at an exposure dose of 1 μJ/cm$^2$.

[Printing Evaluation after Removal of Protective Member (Evaluation of Charge Memory)]

Photoreceptors different from the ones used for the above-described evaluations, which were in a state of being wrapped with the black sheet article, were each left to stand for 24 hours under an environment having a temperature of 10° C. and a relative humidity of 15%. Then, the black sheet article was removed from each photoreceptor. This photoreceptor was mounted on a monochrome printer, DELL 5330dN (manufactured by DELL), and a 2-by-2 half-tone image was output under an environment having a temperature of 10° C. and a relative humidity of 15% to evaluate the presence or absence of image unevenness. The results thereof were evaluated as "○" when no image unevenness was found or "x" when image unevenness was found.

[Evaluation of Light Resistance]

Photoreceptors different from the ones used for the above-described evaluations were each covered with a black paper having an opening arranged on the part to be irradiated with light, and the light of a white fluorescent lamp adjusted to a luminous intensity of 500 1× was irradiated thereto for 30 minutes. Immediately after the completion of the irradiation, each photoreceptor was mounted on a monochrome printer, DELL 5330dN (manufactured by DELL), and a 2-by-2 half-tone image was output to measure the difference in print density between the light-irradiated part and the non-irradiated part. A print density difference of 0.03 or smaller was evaluated as "○", that of 0.04 to 0.06 was evaluated as "Δ", and that of 0.07 or larger was evaluated as "x".

The thus obtained results are shown in Table 2.

TABLE 2

| | Electrical properties | | Surface potential Vo (−V) | | | Half-tone potential Vh (−V) | | | Charge memory | |
|---|---|---|---|---|---|---|---|---|---|---|
| | E1/2 (μJ/cm$^2$) | Vr1 (−V) | Initial | After application of +6 kV | Potential difference ΔVo | Initial | After application of +6 kV | Potential difference ΔVh | Half-tone image unevenness | Light resistance |
| Example 1 | 0.17 | 55 | 600 | 596 | 4 | 300 | 293 | 7 | ○ | ○ |
| Example 2 | 0.17 | 46 | 600 | 591 | 9 | 300 | 289 | 11 | ○ | ○ |
| Example 3 | 0.19 | 61 | 600 | 599 | 1 | 300 | 296 | 4 | ○ | ○ |
| Example 4 | 0.17 | 41 | 600 | 598 | 2 | 300 | 297 | 3 | ○ | ○ |
| Example 5 | 0.17 | 43 | 600 | 592 | 8 | 300 | 291 | 9 | ○ | ○ |
| Example 6 | 0.18 | 57 | 600 | 601 | 1 | 300 | 303 | 3 | ○ | ○ |
| Example 7 | 0.17 | 49 | 600 | 602 | 2 | 300 | 305 | 5 | ○ | ○ |
| Example 8 | 0.16 | 45 | 600 | 600 | 0 | 300 | 299 | 1 | ○ | ○ |
| Example 9 | 0.16 | 47 | 600 | 596 | 4 | 300 | 295 | 5 | ○ | ○ |
| Example 10 | 0.17 | 60 | 600 | 603 | 3 | 300 | 305 | 5 | ○ | ○ |
| Example 11 | 0.17 | 55 | 600 | 596 | 4 | 300 | 293 | 7 | ○ | ○ |
| Example 12 | 0.17 | 55 | 600 | 596 | 4 | 300 | 293 | 7 | ○ | ○ |
| Comparative Example 1 | 0.16 | 45 | 600 | 559 | 41 | 300 | 262 | 38 | x | x |
| Comparative Example 2 | 0.16 | 45 | 600 | 575 | 25 | 300 | 273 | 27 | x | x |
| Comparative Example 3 | 0.28 | 92 | 600 | 605 | 5 | 300 | 307 | 7 | ○ | ○ |
| Comparative Example 4 | 0.16 | 44 | 600 | 580 | 20 | 300 | 278 | 22 | x | x |
| Comparative Example 5 | 0.26 | 83 | 600 | 610 | 10 | 300 | 312 | 12 | ○ | ○ |
| Comparative Example 6 | 0.16 | 48 | 600 | 571 | 29 | 300 | 269 | 31 | x | Δ |
| Comparative Example 7 | 0.16 | 47 | 600 | 579 | 21 | 300 | 278 | 22 | x | Δ |
| Comparative Example 8 | 0.28 | 101 | 600 | 612 | 12 | 300 | 312 | 12 | ○ | ○ |
| Comparative Example 9 | 0.24 | 78 | 600 | 573 | 27 | 300 | 274 | 26 | x | x |
| Comparative Example 10 | 0.20 | 66 | 600 | 564 | 36 | 300 | 266 | 34 | x | x |
| Comparative Example 11 | 0.65 | 152 | 600 | 582 | 18 | 300 | 284 | 16 | x | x |
| Comparative Example 12 | 0.19 | 55 | 600 | 565 | 35 | 300 | 270 | 30 | x | ○ |
| Comparative Example 13 | 0.23 | 74 | 600 | 577 | 23 | 300 | 279 | 21 | x | Δ |
| Comparative Example 14 | 0.30 | 100 | 600 | 582 | 18 | 300 | 283 | 17 | x | ○ |
| Reference Example 1 | 0.17 | 55 | 600 | 596 | 4 | 300 | 293 | 7 | x | ○ |

From the above results, in Examples satisfying the prescribed conditions for the mass ratio ($R_{PN}$) between the hole-transporting substance (P) and the electron-transporting substance (N) as well as for the potential characteristics, it was confirmed that the generation of image unevenness, which is so-called charge memory, on the half-tone image that is caused by triboelectric charging and the like at the time of removing the protective member could be inhibited without imposing a prominent adverse effect on the electrophotographic properties, such as a reduction in the sensitivity or an increase in the residual potential, or on the light resistance.

In contrast, in Comparative Examples 1 and 6 where the charge transport layer contained no electron-transporting substance and Comparative Examples 2, 4 and 7 where the mass ratio ($R_{PN}$) was lower than 1% by mass, the surface potential difference (ΔVo) and half-tone potential difference (ΔVh) between before and after the application of +6 kV were both found to be greater than 15 V and charge memory was generated on the respective half-tone images. In addition, in Comparative Examples 3, 5 and 8 where the mass ratio ($R_{PN}$) was higher than 40% by mass, the reduction in the sensitivity and the increase in the residual potential were both large and prominent adverse effects on the electrophotographic properties were observed. Furthermore, in Comparative Examples 9 to 14 where an electron-transporting substance (ET4 or ET5) was incorporated into the charge transport layer, the surface potential difference (ΔVo) and half-tone potential difference (ΔVh) between before and after the application of +6 kV were both found to be greater than 15 V and charge memory was generated on the respective half-tone images.

From above-described comparisons between Examples and Comparative Examples, the effects of the present invention attained by satisfying the prescribed conditions for the mass ratio ($R_{PN}$) between the hole-transporting substance (P) and the electron-transporting substance (N) and for the potential characteristics were clarified.

DESCRIPTION OF SYMBOLS

1: Conductive substrate
2: Intermediate layer
3: Charge generation layer
4: Charge transport layer
5: Protective layer
11: Electrophotographic photoreceptor
12: Charging means
13: Exposure means
14: Developing means
15: Transfer means
16: Light source for charge removal
17: Cleaning means
18: Recording medium
19: Fixation means

What is claimed is:

1. A negatively-chargeable laminate-type electrophotographic photoreceptor in which a charge generation layer and a charge transport layer are arranged in the order mentioned on a conductive substrate directly or via an intermediate layer, wherein:

said charge transport layer comprises at least a hole-transporting substance, an electron-transporting substance and a binder resin;

the mass ratio ($R_{PN}$) [% by mass] between the mass (P) of said hole-transporting substance and the mass (N) of said electron-transporting substance, which mass ratio is represented by the following equation (1), satisfies the following equation (2):

$$R_{PN}=(N/(P+N))\times 100 \quad (1)$$

$$1\leq R_{PN}\leq 40 \quad (2); \text{ and}$$

when a voltage of +6 kV is applied to said electrophotographic photoreceptor for 5 seconds via a resin sheet having a thickness of 50 μm and a surface resistivity of $2\times10^{7}$ Ω/cm$^2$, the surface potential difference (ΔVo) and half-tone potential difference (ΔVh) between before and after application of said voltage are both 15 V or less.

2. The electrophotographic photoreceptor according to claim 1, wherein at least one of said electron-transporting substance is a compound having a structure represented by the following Formula (ET1):

(ET1)

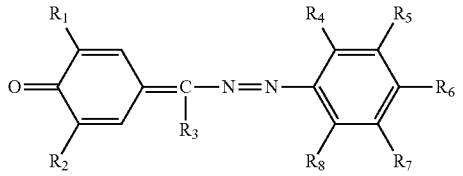

(wherein, $R_1$ and $R_2$, the same or different, represent a hydrogen atom, an alkyl group having 1 to 12 carbon atoms, an alkoxy group having 1 to 12 carbon atoms, an aryl group optionally having a substituent, a cycloalkyl group, an aralkyl group optionally having a substituent or a halogenated alkyl group;

$R_3$ represents a hydrogen atom, an alkyl group having 1 to 6 carbon atoms, an alkoxy group having 1 to 6 carbon atoms, an aryl group optionally having a substituent, a cycloalkyl group, an aralkyl group optionally having a substituent or a halogenated alkyl group;

$R_4$ to $R_8$, the same or different, represent a hydrogen atom, a halogen atom, an alkyl group having 1 to 12 carbon atoms, an alkoxy group having 1 to 12 carbon atoms, an aryl group optionally having a substituent, an aralkyl group optionally having a substituent, a phenoxy group optionally having a substituent, a halogenated alkyl group, a cyano group or a nitro group, or two or more of said groups optionally bind with each other to form a ring; and said substituents represent a halogen atom, an alkyl group having 1 to 6 carbon atoms, an alkoxy group having 1 to 6 carbon atoms, a hydroxyl group, a cyano group, an amino group, a nitro group or a halogenated alkyl group).

3. The electrophotographic photoreceptor according to claim 1, wherein at least one of the electron-transporting substance is a compound having a structure represented by the following Formula (ET2):

(ET2)

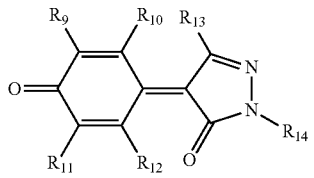

(wherein, $R_9$ to $R_{14}$, the same or different, represent a hydrogen atom, a halogen atom, a cyano group, a nitro group, a hydroxyl group, an alkyl group having 1 to 12 carbon atoms, an alkoxy group having 1 to 12 carbon atoms, an aryl group optionally having a substituent, a heterocyclic group optionally having a substituent, an ester group, a cycloalkyl group, an aralkyl group optionally having a substituent, an allyl group, an amide group, an amino group, an acyl group, an alkenyl group, an alkynyl group, a carboxyl group, a carbonyl group, a carboxylate group or a halogenated alkyl group; and said substituents represent a halogen atom, an alkyl group having 1 to 6 carbon atoms, an alkoxy group having 1 to 6 carbon atoms, a hydroxyl group, a cyano group, an amino group, a nitro group or a halogenated alkyl group).

4. The electrophotographic photoreceptor according to claim 1, wherein at least one of the electron-transporting substance is a compound having a structure represented by the following Formula (ET3):

(ET3)

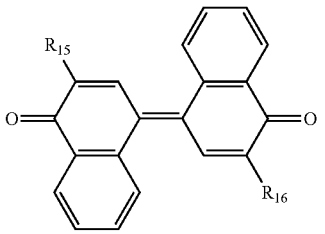

(wherein, $R_{15}$ and $R_{16}$, the same or different, represent a hydrogen atom, a halogen atom, a cyano group, a nitro group, a hydroxyl group, an alkyl group having 1 to 12 carbon atoms, an alkoxy group having 1 to 12 carbon atoms, an aryl group optionally having a substituent, a heterocyclic group optionally having a substituent, an ester group, a cycloalkyl group, an aralkyl group optionally having a substituent, an allyl group, an amide group, an amino group, an acyl group, an alkenyl group, an alkynyl group, a carboxyl group, a carbonyl group, a carboxylate group or a halogenated alkyl group; and said substituents represent a halogen atom, an alkyl group having 1 to 6 carbon atoms, an alkoxy group having 1 to 6 carbon atoms, a hydroxyl group, a cyano group, an amino group, a nitro group or a halogenated alkyl group).

5. An electrophotographic apparatus comprising:

the electrophotographic photoreceptor according to claim 1;

a charging means which charges said electrophotographic photoreceptor;

an exposure means which exposes the thus charged electrophotographic photoreceptor to form an electrostatic latent image;

a developing means which develops said electrostatic latent image formed on said electrophotographic photoreceptor with a toner to form a toner image;

a transfer means which transfers said toner image formed on said electrophotographic photoreceptor to a recording medium; and a fixation means which fixes said toner image transferred to said recording medium.

6. A package of an electrophotographic photoreceptor, in which the electrophotographic photoreceptor according to claim 1 is covered with a black sheet article, wherein said black sheet article has a thickness of 30 to 80 μm and a surface resistivity of $10^2$ to $10^{11}$ Ω/cm$^2$.

* * * * *